US006572301B1

(12) United States Patent
Robinson

(10) Patent No.: US 6,572,301 B1
(45) Date of Patent: Jun. 3, 2003

(54) SOAP DISPENSING TOY

(76) Inventor: Targrew Robinson, 92-47 173rd St., Jamaica, NY (US) 11433

( * ) Notice: Subject to any disclaimer, the term of this patent is extended or adjusted under 35 U.S.C. 154(b) by 0 days.

(21) Appl. No.: 10/003,303

(22) Filed: Nov. 2, 2001

(51) Int. Cl.[7] ..... B05C 11/00
(52) U.S. Cl. ..... 401/266; 401/201; 401/265
(58) Field of Search ..... 401/266, 201, 401/202, 196, 265, 261, 262

(56) References Cited

U.S. PATENT DOCUMENTS

| | | | | | |
|---|---|---|---|---|---|
| 2,927,335 | A | | 3/1960 | Hammond | |
| 3,143,755 | A | * | 8/1964 | Rowley | 401/201 |
| 4,148,318 | A | | 4/1979 | Meyer | |
| 4,674,903 | A | | 6/1987 | Chen | |
| 5,183,429 | A | | 2/1993 | Bitton | |
| 5,397,194 | A | * | 3/1995 | Yuan et al. | 401/266 |
| D381,150 | S | | 7/1997 | Berti | |
| 5,704,723 | A | | 1/1998 | Salisian | |
| 5,758,983 | A | * | 6/1998 | Thomas | 401/266 |
| 6,036,393 | A | * | 3/2000 | Youtcheff et al. | 401/201 |

* cited by examiner

*Primary Examiner*—David J. Walczak

(57) ABSTRACT

A soap dispensing toy for promoting good hygiene and providing entertainment. The soap dispensing toy includes a container. The container has a bottom side. A peripheral wall is integrally coupled to and extends upwardly away from the bottom side such that a lumen is defined between the bottom side and the peripheral wall. The peripheral wall has an aperture therein. A cap member is selectively coupled to an edge of the aperture such that the cap member may cover the aperture. The container generally resembles a figurine and generally comprises a resiliently flexible material. A sponge portion is securely coupled to a bottom surface of the bottom side. Soap is placed in the container by way of the aperture. The soap may then travel through the hole and into the sponge.

5 Claims, 2 Drawing Sheets

SOAP DISPENSING TOY

BACKGROUND OF THE INVENTION

1. Field of the Invention

The present invention relates to toys for use while bathing and more particularly pertains to a new soap dispensing toy for promoting good hygiene and providing entertainment.

2. Description of the Prior Art

The use of toys for use while bathing is known in the prior art. More specifically, toys for use while bathing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,704,723; 2,927,335; 5,183,429; 4,676,903; Des. 381,150; and 4,148,318.

While these devices fulfill their respective, particular objectives and requirements, the aforementioned patents do not disclose a new soap dispensing toy. The inventive device includes a container. The container has a bottom side. The bottom side has at least one hole therein. A peripheral wall is integrally coupled to and extends upwardly away from the bottom side such that a lumen is defined between the bottom side and the peripheral wall. The peripheral wall has an aperture therein. A cap member is selectively coupled to an edge of the aperture such that the cap member may cover the aperture. The container generally resembles a figurine and generally comprises a resiliently flexible material. A sponge portion is securely coupled to a bottom surface of the bottom side. Soap is placed in the container by way of the aperture. The soap may then travel through the hole and into the sponge.

In these respects, the soap dispensing toy according to the present invention substantially departs from the conventional concepts and designs of the prior art, and in so doing provides an apparatus primarily developed for the purpose of promoting good hygiene and providing entertainment.

SUMMARY OF THE INVENTION

In view of the foregoing disadvantages inherent in the known types of toys for'use while, bathing now present in the prior art, the present invention provides a new soap dispensing toy construction wherein the same can be utilized for promoting good hygiene and providing entertainment.

The general purpose of the present invention, which will be described subsequently in greater detail, is to provide a new soap dispensing toy apparatus and method which has many of the advantages of the toys for use while bathing mentioned heretofore and many novel features that result in a new soap dispensing toy which is not anticipated, rendered obvious, suggested, or even implied by any of the prior art toys for use while bathing, either alone or in any combination thereof.

To attain this, the present invention generally comprises a container. The container has a bottom side. The bottom side has at least one hole therein. A peripheral wall is integrally coupled to and extends upwardly away from the bottom side such that a lumen is defined between the bottom side and the peripheral wall. The peripheral wall has an aperture therein. A cap member is selectively coupled to an edge of the aperture such that the cap member may cover the aperture. The container generally resembles a figurine and generally comprises a resiliently flexible material. A sponge portion is securely coupled to a bottom surface of the bottom side. Soap is placed in the container by way of the aperture. The soap may then travel through the hole and into the sponge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soap dispensing toy apparatus and method which has many of the advantages of the toys for use while bathing mentioned heretofore and many novel features that result in a new soap dispensing toy which is not anticipated, rendered obvious, suggested, or even implied by any of the prior art toys for use while bathing, either alone or in any combination thereof.

It is another object of the present invention to provide a new soap dispensing toy which may be easily and efficiently manufactured and marketed.

It is a further object of the present invention to provide a new soap dispensing toy which is of a durable and reliable construction.

An even further object of the present invention is to provide a new soap dispensing toy which is susceptible of a low cost of manufacture with regard to both materials and labor, and which accordingly is then susceptible of low prices of sale to the consuming public, thereby making such soap dispensing toy economically available to the buying public.

Still yet another object of the present invention is to provide a new soap dispensing toy which provides in the apparatuses and methods of the prior art some of the advantages thereof, while simultaneously overcoming some of the disadvantages normally associated therewith.

Still another object of the present invention is to provide a new soap dispensing toy for promoting good hygiene and providing entertainment.

Yet another object of the present invention is to provide a new soap dispensing toy which includes a container. The container has a bottom side. The bottom side has at least one hole therein. A peripheral wall is integrally coupled to and extends upwardly away from the bottom side such that a lumen is defined between the bottom side and the peripheral wall. The peripheral wall has an aperture therein. A cap member is selectively coupled to an edge of the aperture such that the cap member may cover the aperture. The container generally resembles a figurine and generally comprises a resiliently flexible material. A sponge portion is securely coupled to a bottom surface of the bottom side. Soap is placed in the container by way of the aperture. The soap may then travel through the hole and into the sponge.

Still yet another object of the present invention is to provide a new soap dispensing toy that has embodiments capable of holding liquid and bar soap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
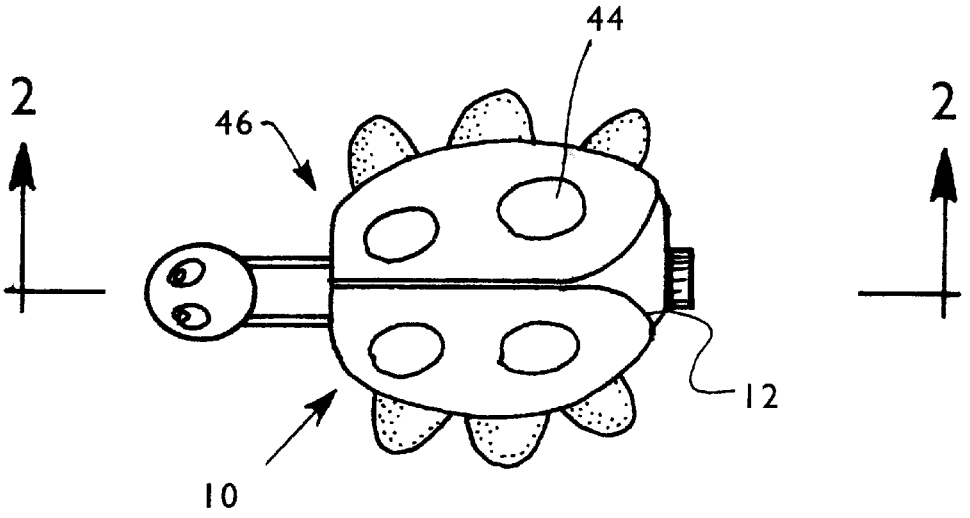
FIG. 1 is a schematic top view of the first embodiment of the present invention of a new soap dispensing toy according to the present invention.

With reference now to the drawings, and in particular to FIGS. 1 through 5 thereof, a new soap dispensing toy embodying the principles and concepts of the present invention and generally designated by the reference numeral 10 will be described.

As best illustrated in FIGS. 1 through 5, the soap dispensing toy 10 generally comprises a container 12. The container 12 comprises a bottom side 14. The bottom side 14 has at least one hole 16 therein. A peripheral wall 18 is integrally coupled to and extends upwardly away from the bottom side 14 such that a lumen 20 is defined between the bottom side 14 and the peripheral wall 18. The peripheral wall 18 has an aperture 22 therein. A cap member 24 is adapted to selectively couple to an edge of the aperture 22 such that the cap member 24 may cover the aperture. The container 12 generally resembles a figurine and is preferably comprised of a resiliently flexible material such as plastic or an elastomeric material.

A sponge portion 26 is securely coupled to a bottom surface of the bottom side 14. Generally, a liquid soap 70 placed in the container 12 may travel through the hole 16 and into the sponge portion 26.

Figure 2:
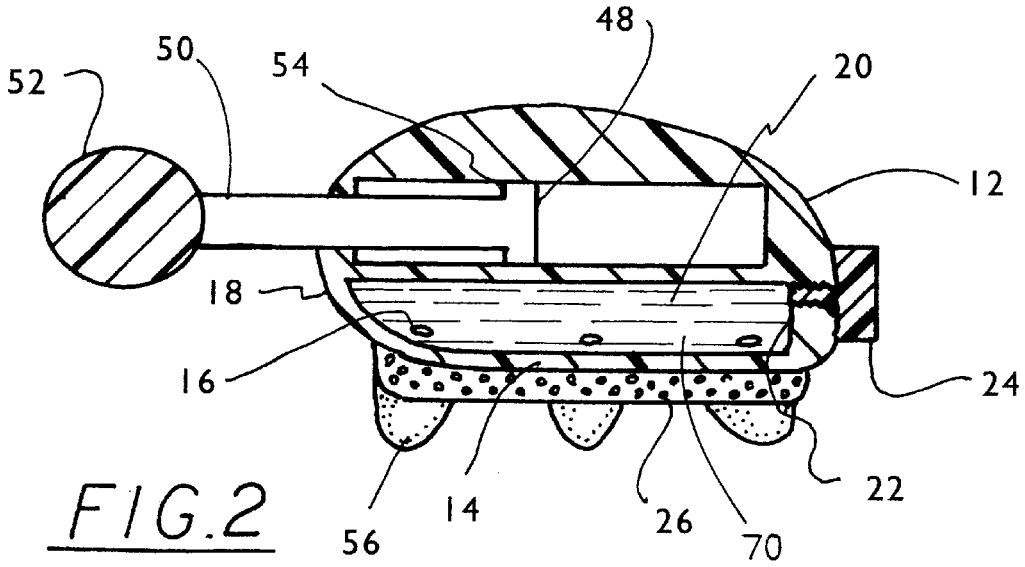
FIG. 2 is a schematic cross-sectional view taken along line 2—2 of the first embodiment of the present invention.

The first embodiment, shown in FIGS. 1 and 2 resembles a ladybug. The peripheral wall 18 of the first embodiment has a plurality of nodules 44 thereon and extending away therefrom. A head portion 46 of the lady bug comprises an elongate member 50 having a first end 52 and second end 54. The first end 52 is bulbous and resembles an insect head. The second end 54 is slidably insertable through the peripheral wall 18. The head portion 46 is selectively positionable between and extended and a retracted position. In the extended position, as shown in FIG. 2, the head portion acts 46 as a handle. The second end 54 of the head portion has a plate 48 thereon that will abut the inside surface of the peripheral wall 18 when in the extended position. The sponge portion 26 has six protruding members 56 thereon representing legs.

Figure 3:
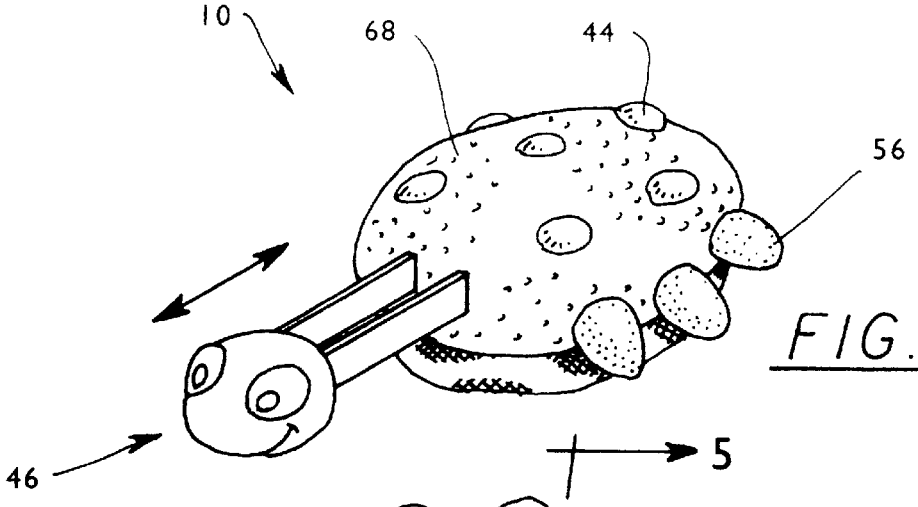
FIG. 3 is a schematic perspective view of the second embodiment of the present invention.
Figure 4:
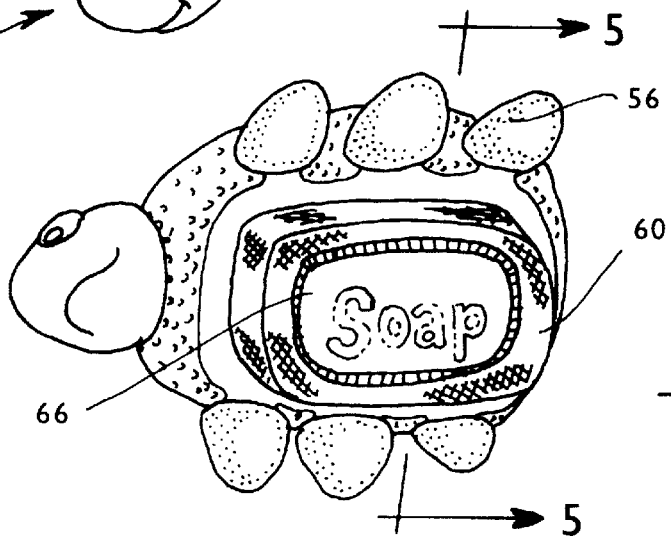
FIG. 4 is a schematic bottom perspective view of the second embodiment of the present invention.
Figure 5:
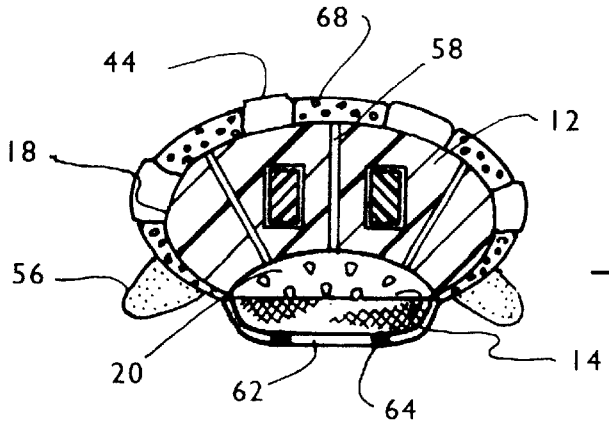
FIG. 5 is a schematic cross-sectional view taken along line 5—5 of the second embodiment of the present invention.

The second embodiment, shown in FIGS. 3, 4, and 5 also represents a ladybug and is similar to the first embodiment. The bottom side 14 of the second embodiment has no hole therein. Instead there are a plurality of holes 58 in the peripheral wall 18 that extend into the lumen 20. There are two sponge portions in the second embodiment. A first sponge portion 60 is securely coupled to a bottom surface of the bottom side 14. The first sponge portion 60 has a channel 62 therein. An elastic material 64 is securely attached to the first sponge portion 60 and lines the channel 62. A generally rigid portion of soap 66, a conventional bar of soap, may be positioned in the channel 62. A second sponge portion 68 is securely attached to an outside portion of the peripheral wall 18. The nodules 44 extend through the second sponge portion 68. A generally fluid volume of soap may placed in the container 12 may travel through the holes 58 and into the second sponge portion 68.

In use, the lumen 20 is filled with liquid soap 70 which travels through the hole 16, or holes 58, and onto the sponge portions. The second embodiment also accommodates bar soap 66.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soap dispensing toy device, said device comprising:

a container, said container comprising;

a bottom side, said bottom side having at least one hole therein;

a peripheral wall being integrally coupled to and extending upwardly away from said bottom side such that a lumen is defined between said bottom side and said peripheral wall, said peripheral wall having an aperture therein extending into said lumen;

a cap member, said cap member being selectively coupled to an edge of said aperture such that said cap member may cover said aperture;

wherein said container generally resembles a figurine, said container generally comprising a resiliently flexible material;

a sponge portion, said sponge portion being securely coupled to a bottom surface of said bottom side; and wherein soap placed in said container may travel through said hole and into said sponge;

wherein said container resembles a lady bug, a head portion of said lady bug comprising an elongate member having a first end and second end, said first end being bulbous and resembling an insect head, said second being slidably insertable through said peripheral wall, wherein said head portion is selectively positionable between an extended and a retracted position, said second end of said head portion having a plate thereon.

2. The soap dispensing toy device as in claim 1, wherein said container further comprises:

said peripheral wall having a plurality of nodules thereon and extending away therefrom.

3. The soap dispensing toy device as in claim 1, wherein said sponge portion further comprises:

said sponge portion having six protruding members thereon, said protruding members representing legs.

4. A soap dispensing toy device, said device comprising:

a container, said container comprising;

a bottom side, said bottom side having at least one hole therein;

a peripheral wall being integrally coupled to and extending upwardly away from said bottom side such that a lumen is defined between said bottom side and said peripheral wall, said peripheral wall having an aperture therein extending into said lumen, said peripheral wall having a plurality of nodules thereon and extending away therefrom;

a cap member, said cap member being selectively coupled to an edge of said aperture such that said cap member may cover said aperture;

wherein said container generally resembles a ladybug, said container generally comprising a resiliently flexible material;

a head portion of said lady bug comprising an elongate member having a first end and second end, said first end being bulbous and resembling an insect head, said second being slidably insertable through said peripheral wall, wherein said head portion is selectively positionable between an extended and a retracted position, said second end of said head portion having a plate thereon;

a sponge portion, said sponge portion being securely coupled to a bottom surface of said bottom side, said sponge portion having six protruding members thereon, said protruding members representing legs; and wherein soap placed in said container may travel through said hole and into said sponge.

5. A soap dispensing toy device, said device comprising:

a container, said container comprising;

a bottom side;

a peripheral wall being integrally coupled to and extending upwardly away from said bottom side such that a lumen is defined between said bottom side and said peripheral wall, said peripheral wall having an aperture therein, said peripheral wall having a plurality of nodules thereon and extending away therefrom, said peripheral wall having a plurality of holes therein extending into said lumen;

a cap member, said cap member being selectively coupled to an edge of said aperture such that said cap member may cover said aperture;

wherein said container generally resembles a ladybug, said container generally comprising a resiliently flexible material;

a head portion of said lady bug comprising an elongate member having a first end and second end, said first end being bulbous and resembling an insect head, said second being slidably insertable through said peripheral wall, wherein said head portion is selectively positionable between an extended and a retracted position, said second end of said head portion having a plate thereon;

a first sponge portion, said first sponge portion being securely coupled to a bottom surface of said bottom side, said first sponge portion having a channel therein, an elastic material being securely attached to said first sponge portion and lining said channel, wherein a generally rigid portion of soap may be positioned in said channel; and a second sponge portion, said second sponge portion being securely attached to an outside portion of said peripheral wall, said nodules extending through said second sponge portion; and wherein a generally fluid volume of soap placed in said container may travel through said holes and into said sponge.

* * * * *